US008362699B2

(12) United States Patent
Eden et al.

(10) Patent No.: US 8,362,699 B2
(45) Date of Patent: Jan. 29, 2013

(54) INTERWOVEN WIRE MESH MICROCAVITY PLASMA ARRAYS

(75) Inventors: J. Gary Eden, Champaign, IL (US); Sung-Jin Park, Champaign, IL (US); Andrew J. Price, Savoy, IL (US); Jason D. Readle, Chonnahen, IL (US); Clark J. Wagner, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 12/682,973

(22) PCT Filed: Oct. 27, 2008

(86) PCT No.: PCT/US2008/081270

§ 371 (c)(1),
(2), (4) Date: Aug. 2, 2010

(87) PCT Pub. No.: WO2009/055764

PCT Pub. Date: Apr. 30, 2009

(65) Prior Publication Data

US 2011/0260609 A1 Oct. 27, 2011

Related U.S. Application Data

(60) Provisional application No. 61/000,387, filed on Oct. 25, 2007.

(51) Int. Cl.
*H01J 17/49* (2006.01)
*H01J 9/00* (2006.01)

(52) U.S. Cl. ..... 313/582; 313/355; 205/199; 205/324; 445/24

(58) Field of Classification Search ..... None
See application file for complete search history.

(56) References Cited

U.S. PATENT DOCUMENTS

| | | | |
|---|---|---|---|
| 3,551,303 | A | 12/1970 | Suzuki et al. |
| 5,189,405 | A | 2/1993 | Yamashita et al. |
| 5,928,426 | A | 7/1999 | Aitchison |
| 7,642,720 | B2 | 1/2010 | Eden et al. |
| 2002/0088945 | A1 | 7/2002 | Matschke |
| 2003/0080664 | A1 | 5/2003 | Eden et al. |
| 2006/0082319 | A1 | 4/2006 | Eden et al. |

(Continued)

FOREIGN PATENT DOCUMENTS

| | | |
|---|---|---|
| GB | 2 012 305 | 12/1977 |
| JP | 05-144569 | 6/1993 |

(Continued)

OTHER PUBLICATIONS

Jessensky, O., et al., "Self-organized formation of hexagonal pore arrays in anodic alumina", *Applied Physics Letters*, vol. 72, No. 10, Mar. 9, 1998.

(Continued)

*Primary Examiner* — Ashok Patel
(74) *Attorney, Agent, or Firm* — Greer, Burns & Crain Ltd.

(57) ABSTRACT

Embodiments of the invention provide for large arrays of microcavity plasma devices that can be made inexpensively, and can produce large area but thin displays or lighting sources Interwoven metal wire mesh, such as interwoven Al mesh, consists of two sets of wires which are interwoven in such a way that the two wire sets cross each other, typically at πght angles (90 degrees) although other patterns are also available Fabrication is accomplished with a simple and inexpensive wet chemical etching process The wires in each set are spaced from one another such that the finished mesh forms an array of openings that can be, for example, square, rectangular or diamond-shaped The size of the openings or microcavities is a function of the diameter of the wires in the mesh and the spacing between the wires in the mesh used to form the array of microcavity plasma devices.

31 Claims, 7 Drawing Sheets

U.S. PATENT DOCUMENTS

| | | | |
|---|---|---|---|
| 2006/0132014 | A1 | 6/2006 | Horiuchi |
| 2007/0132387 | A1 | 6/2007 | Moore |
| 2007/0170866 | A1 | 7/2007 | Eden et al. |
| 2008/0185579 | A1 | 8/2008 | Eden et al. |
| 2010/0001629 | A1 | 1/2010 | Eden et al. |
| 2011/0275272 | A1 | 11/2011 | Eden et al. |

FOREIGN PATENT DOCUMENTS

| | | |
|---|---|---|
| JP | 06-310103 | 11/1994 |
| JP | 2004-211116 | 7/2004 |
| JP | 2005-256071 | 9/2005 |
| WO | WO 2007/087285 | 8/2007 |
| WO | WO 2008/013820 | 1/2008 |

OTHER PUBLICATIONS

Kim, K,S., et. al., "Self-patterned aluminum interconnects and ring electrodes for arrays of microcavity plasma devices encapsulated in $Al_2O_3$", *J. Phys. D., Appl. Phys*., (2008) 41.

Kim, K.S., et. al., "27.3: Fully Addressable, Self-Assembled Microcavity Plasma Arrays: Improved Luminous Efficacy by Controlling Device Geometry", *SID 08 Digest*, 2008.

Park, S-J., et. al., "P-90: Large Scale Arrays of Microcavity Plasma Devices Based on Encapsulated $Al/Al_2O_3$ Electrodes: Device Characteristics as a Plasma Display Pixel and Low Cost Wet Chemical Fabrication Processing", *SID 07 Digest*, 2007.

Park, S-J., et. al., "Microdischarge Arrays: A New Family of Photonic Devices", *IEEE Journal on Selected Topics in Quantum Electronics*, vol. 8, No. 1, Jan./Feb. 2002.

6. Park, S-J., et al., "Nanoporous alumina as a dielectric for microcavity plasma devices: Multilayer Al/Al2O3 Structures", Applied Physics Letters, 86, Year-2005.

Park, S-J., et, al.. "Flexible microdischarge arrays: Metal/polymer devices", *Applied Physics Letters*, vol. 7, No. 22, Jul. 10, 2000.

White, A.D., "New Hollow Cathode Glow Discharge"; *Journal of Applied Physics*, vol. 30, No. 5, May 1959.

INTERWOVEN WIRE MESH MICROCAVITY PLASMA ARRAYS

PRIORITY CLAIM AND REFERENCE TO RELATED APPLICATION

This application claims priority under 35 U.S.C. §119 from prior provisional application Ser. No. 61/000,387, which was filed on Oct. 25, 2007.

STATEMENT OF GOVERNMENT INTEREST

This invention was made with government support under contract number FA9550-07-1-0003 awarded by Air Force Office of Scientific Research. The government has certain rights in the invention.

FIELD

A field of the invention is microcavity plasma devices (also known as microdischarge devices) and arrays of microcavity plasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Work done by University of Illinois researchers is disclosed in U.S. Published Application Number 20070170866, to Eden et al., which is entitled Arrays of Microcavity Plasma Devices with Dielectric Encapsulated Electrodes. That application discloses microcavity plasma devices and arrays with thin foil metal electrodes protected by metal oxide dielectric. The devices and arrays disclosed are based upon thin foils of metal that are available or can be produced in arbitrary lengths, such as on rolls. A method of manufacturing disclosed in the application discloses a first electrode pre-formed with microcavities having the desired cross-sectional geometry. Pre-formed screen-like metal foil, e.g. Al screens used in the battery industry, can be used with the disclosed methods. Oxide is subsequently grown on the foil, including on the inside walls of the microcavities (where plasma is to be produced), by wet electrochemical processing (anodization) of the foil. As disclosed in the application, providing a conductive thin foil with microcavities includes either fabricating the cavities in conductive foil by any of a variety of processes (laser ablation, chemical etching, etc.) or obtaining a conductive thin foil with pre-fabricated microcavities from a supplier. A wide variety of microcavity shapes and cross-sectional geometries can be formed in conductive foils according to the method disclosed in the application.

More recent work by University of Illinois researchers discloses buried circumferential electrode microcavity plasma device arrays and a self-patterned wet chemical etching formation method including controlled interconnections between. This invention is disclosed in Eden et al., U.S. patent application Ser. No. 11/880,698, filed Jul. 24, 2007, entitled Buried Circumferential Electrode Microcavity Plasma Device Arrays, and Self-Patterned Formation Method, which has been published as WO 08/013,820 on Jan. 31, 2008 and as US 2008-0185579 on Aug. 7, 2008. In a disclosed method of formation in that application, a metal foil or film is obtained or formed with microcavities (such as through holes), and the foil or film is anodized to form metal oxide. One or more self-patterned metal electrodes are automatically formed and buried in the metal oxide created by the anodization process. The electrodes form in a closed circumference (a ring if the cavity shape is circular) around each microcavity, and the electrodes for the microcavities can be electrically isolated or connected. Prior to processing, microcavities (such as through holes) of the desired shape are produced in a metal electrode (e.g., a foil or film). The electrode is subsequently anodized so as to convert virtually all of the electrode into a dielectric (normally an oxide). The anodization process and microcavity placement determines whether adjacent microcavities in an array are electrically connected or not.

SUMMARY OF THE INVENTION

Embodiments of the invention provide for large arrays of microcavity plasma devices that can be made inexpensively, and can produce large area but thin displays or lighting sources. Interwoven metal wire mesh, such as interwoven Al mesh (often known as wire fabric), consists of two sets of wires which are interwoven in such a way that the two wire sets cross each other, typically at right angles (90° although other patterns are also available. Fabrication is accomplished with a simple and inexpensive wet chemical etching process. The wires in each set are spaced from one another such that the finished mesh forms an array of openings that can be, for example, square, rectangular or diamond-shaped. The size of the openings or microcavities is a function of the diameter of the wires in the mesh and the spacing between the wires in the mesh used to form the array of microcavity plasma devices. In preferred arrays of the invention, microcavity plasma devices are separately addressable. Each wire in the interwoven wire mesh electrode is isolated from all other wires, providing separately addressable microcavity plasma devices in an array.

Devices of the invention are amenable to mass production techniques which may include, for example, roll to roll processing to bond together first and second thin packaging layers with wire mesh between them. Embodiments of the invention provide for large arrays of microcavity plasma devices that can be made inexpensively. Also, exemplary devices of the invention are formed from a single sheet of wire mesh that is flexible.

DETAILED DESCRIPTION OF THE PREFERRED EMBODIMENTS

Figure 1A:
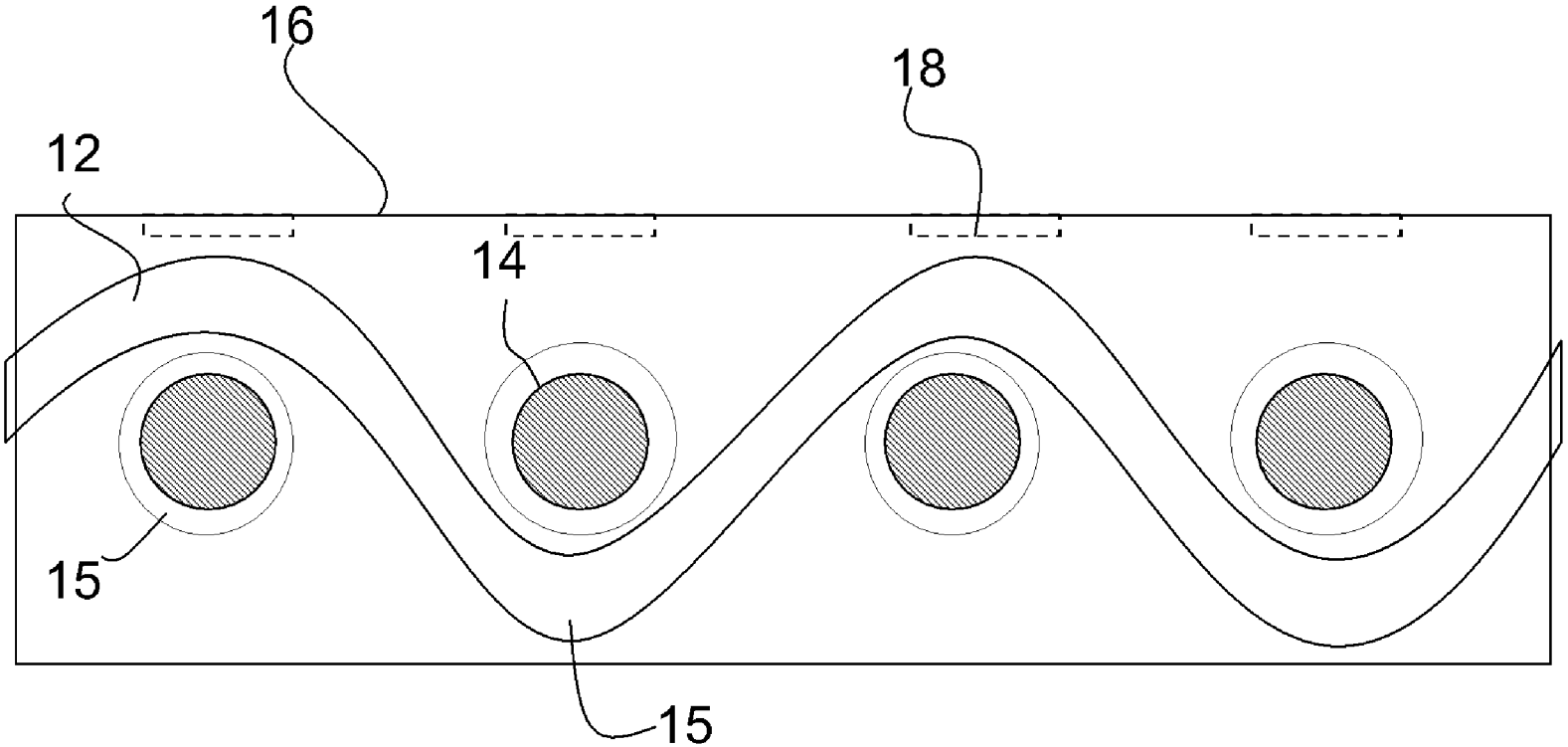
FIG. 1A is a cross-sectional diagram of a section of an array of microcavity plasma devices of the invention.

The invention concerns microcavity plasma devices, and arrays of devices, in which thin interwoven wire mesh metal electrodes are protected by a thin layer of metal oxide dielectric covering each wire. This thin dielectric coating electrically insulates (isolates) each wire from all others in the mesh. Devices of the invention are amenable to mass production techniques, and may, for example, be fabricated by roll to roll processing. Exemplary devices of the invention are flexible.

Embodiments of the invention provide for large arrays of microcavity plasma devices that can be made inexpensively, and can produce large area displays or lamps in the form of a sheet. Interwoven metal wire mesh, such as interwoven Al mesh (often known as wire fabric), consists of two sets of wires which are interwoven in such a way that the two wire sets cross each other, typically at right angles (90° although other patterns are also available. Fabrication is accomplished with a simple and inexpensive wet chemical etching process. The wires in each set are spaced from one another such that the finished mesh forms an array of openings that can be, for example, square, rectangular, or diamond-shaped. The size of the openings or microcavities is a function of the diameter of the wires in the mesh and the spacing between the wires in the mesh used to form the array of microcavity plasma devices. In preferred arrays of the invention, microcavity plasma devices are separately addressable. Each wire in the interwoven wire mesh electrode is isolated from all other wires, providing separately addressable microcavity plasma devices in an array.

A method of fabrication of the invention involves anodization of the interwoven wire mesh such that each wire in the mesh is electrically insulated (isolated) from all others. Each wire can, therefore, serve as an addressing line for a display, for example. Addressable, large area arrays can be made with the simple step of anodization of an interwoven wire mesh, and the size of each resultant pixel or sub-pixel (microcavity) is determined by the design interwoven wire mesh which is available commercially in a wide range of patterns, wire diameters, and wire spacings. Arrays of the invention can also flexible, permitting their use in many applications. For example, they can be formed into cylinders and can be used as plasma reactors and light sources in cylindrical geometry in addition to their clear utility in flat panel displays and general lighting applications.

Devices of the invention are amenable to mass production techniques which may include, for example, roll to roll processing to bond together first and second thin packaging layers with wire mesh between them. Embodiments of the invention provide for large arrays of microcavity plasma devices that can be made inexpensively. Also, exemplary devices of the invention are formed from a single sheet of wire mesh that is flexible.

Preferred materials for the metal electrodes and metal oxide are aluminum and aluminum oxide ($Al/Al_2O_3$). Another exemplary metal/metal oxide material system is titanium and titanium dioxide ($Ti/TiO_2$). Other metal/metal oxide materials systems will be apparent to artisans. Preferred material systems permit the formation of microcavity plasma device arrays of the invention by inexpensive, mass production techniques such as roll to roll processing.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

Interwoven wire mesh is typically woven in such a way that a small gap exists between the wires in each set. FIG. 1A is a side view of a portion of a wire mesh in which two sets of wires are interwoven. For example, wire 12 alternately passes over and under the set of wires 14 that are nominally parallel to one another but roughly orthogonal to wire 12. Although not evident in FIG. 1A, other wires parallel to 12, also are present. The small gap between one wire and its neighbors in the mesh permits separate X and Y electrodes 12 and 14 (see FIG. 1A) to be separately addressable and, when anodized, electrically insulated from each other. By anodizing each wire along its full length, the electrodes 12 and 14 become encapsulated in oxide 15 and are each insulated from all other electrodes in the mesh. Once anodized, the electrode mesh can be sealed within a packaging layer 16 of, for example, thin glass sheets or plastic. Before or after sealing, a discharge gas, vapor or combinations of gases or vapors that can sustain a plasma can be introduced to the mesh to fill all of the microcavities. Phosphors 18 (if desired) can be applied outside or inside the packaging and patterned to form pixels or sub-pixels to produce a color display that is fully addressable. The phosphors 18 are disposed so as to be excited by plasma generated in the microcavities in the mesh. The resolution of a display using an array of microcavity plasma devices of the invention is a function of the physical arrangement and dimensions of the interwoven wire mesh used to form the array. Alternatively, the array of microcavities can be applied as a lighting source. If the phosphor 18 in FIG. 1A is printed in a continuous layer rather than as strips (as shown in FIG. 1A), the light emerging from the microcavities will efficiently excite the phosphor.

Figure 1B:
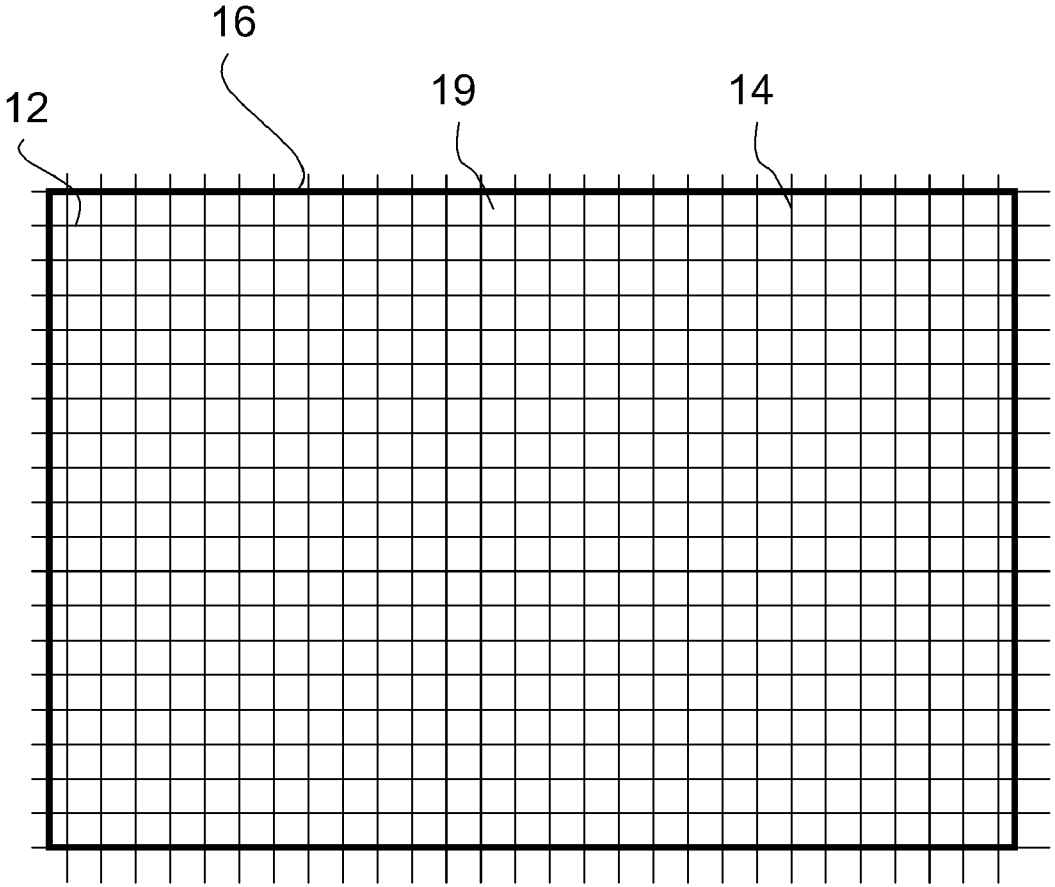
FIG. 1B is a plan (top) view of the FIG. 1A array of microcavity plasma devices of the invention.

FIG. 1B is a schematic top view of the array of FIG. 1A. Microcavities 19 have within them discharge gas(es) and/or vapor(s) or mixtures, and a plasma is generated when a time-varying voltage of the proper magnitude is applied between electrodes 12 and 14 that together define given microcavity 19 in the array. The wire mesh of FIG. 1B enables very thin microcavity plasma device arrays with individually addressed microcavities. The depth of the microcavities 19 approximates the thickness of the anodized wire mesh of electrodes 12 and 14, and the thin glass, polymer, etc. packaging layer creates minimal additional thickness. With application of an appropriate time varying voltage, the electrodes 12 and 14 drive and sustain plasma formation in the microcavities 19.

The top packaging layer(s) 16 can be selected from a wide range of suitable materials, which can be completely transparent to emission wavelengths produced by the microplasmas or can, for example, filter the output wavelengths of the microcavity plasma device array 10 so as to transmit radiation only in specific spectral regions. Example materials include thin glass, quartz, or plastic layers and FIG. 1B indicates the perimeter of a square, top window intended for sealing the array. The discharge medium can be contained at or near atmospheric pressure, permitting the use of a very thin glass or plastic layer because of the small pressure differential across the packaging layer, which can also be two separate layers. Polymeric vacuum packaging, such as that used in the food industry to seal various food items, can also be used as a packaging layer.

Packaging of the arrays can be accomplished by simple fabrication processes. All of the interwoven wire mesh arrays of the invention can be packaged either in glass, quartz, plastic. In the case of plastic, heating the mesh to the proper temperature and bringing it into contact with a plastic film or sheet will soften the plastic and fix the mesh into its proper position on the plastic sheet. The plastic will cool quickly, locking the mesh into position. Subsequently, the second half of the plastic package can be bonded to the first, completing the assembly prior to backfilling the array with the desired gas or gas mixture. The wire leads can be sealed by slightly heating plastic at the edge of the package, and pressing the plastic around the leads. In addition to displays, the invention provides inexpensive, large area arrays for signage and lighting.

While square microcavities 19 are illustrated in FIG. 1B as a result of the wire mesh having a straight "over and under" weave, the shape of the microcavities is established by the mesh used to form the array, and meshes are available with openings (microcavities) of a variety of shapes, including square, rectangular, and diamond. The arrays can also be flexible.

Figure 1C:
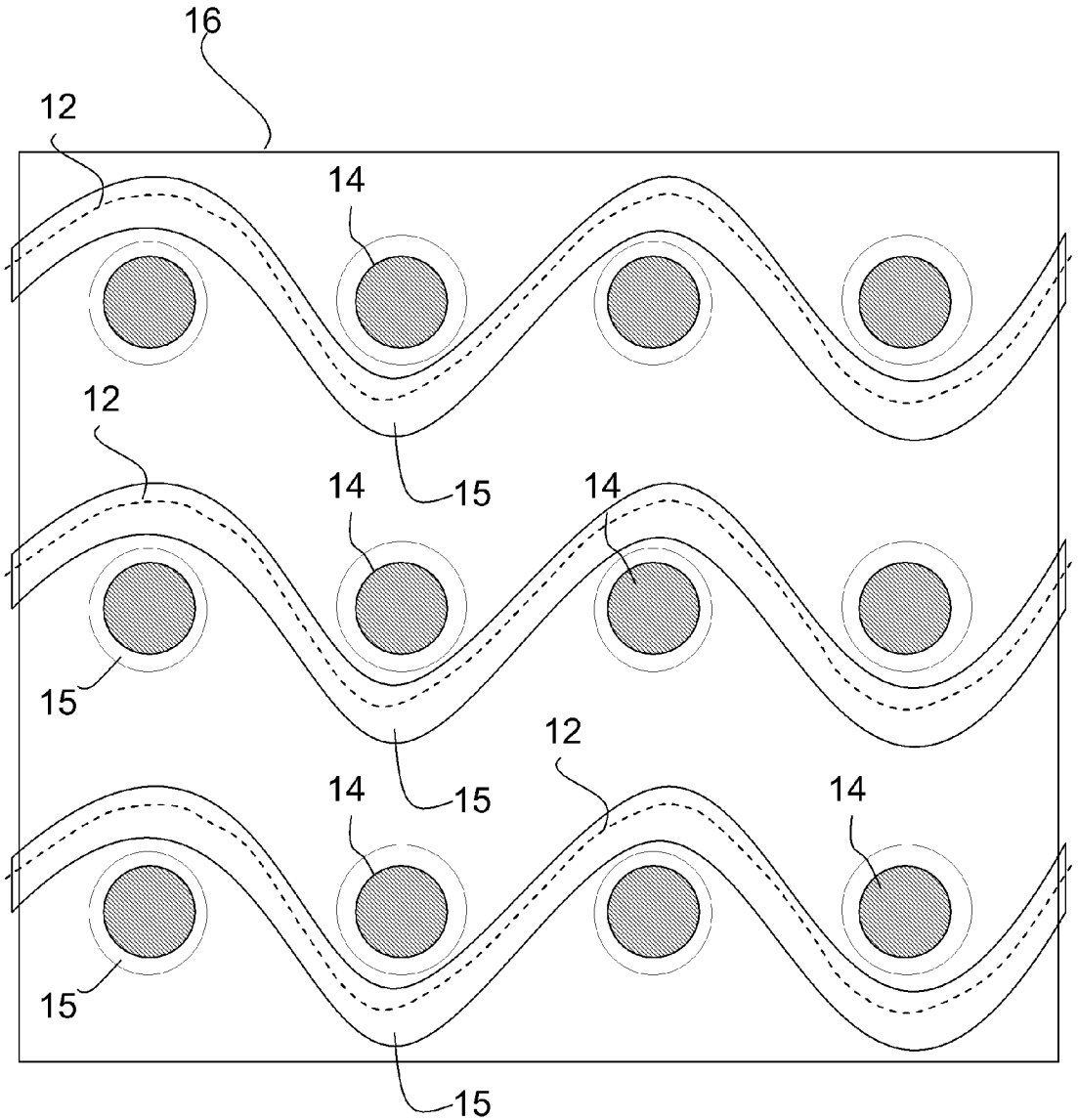
FIG. 1C is a diagram of a portion of a three-dimensional, multiple layer array of microcavity plasma devices of the invention.

In addition to the single layer of interwoven mesh as illustrated in FIGS. 1A and 1B, multiple mesh layers can be used. For example, stacking three (or more) layers as shown in the embodiment of FIG. 1C can be used to produce a three-dimensional (3D) display, or a plasma reactor. Also, transparent arrays can be formed. By driving the anodization process nearly to completion, the wires in each layer of interwoven mesh are reduced to thin metal threads at the center of transparent metal oxide wires and the entire structure is essentially transparent.

Figure 2:
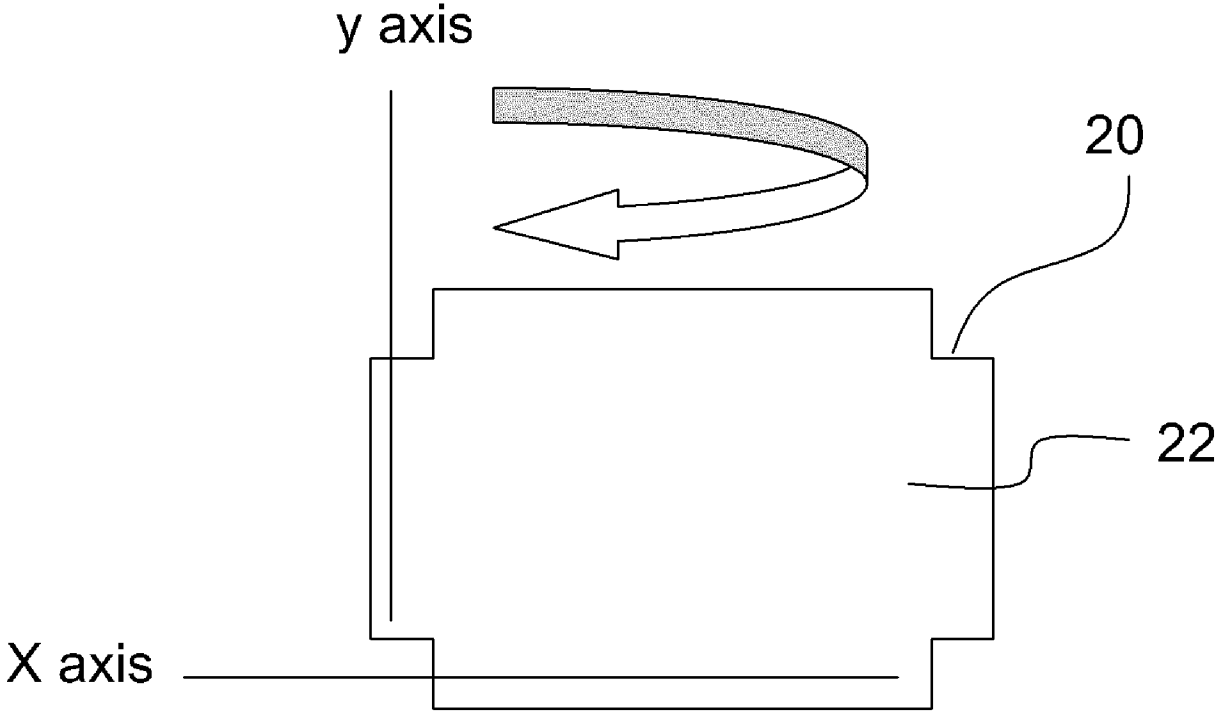
FIG. 2 illustrates a method for making a cylindrical array of microcavity plasma devices of the invention.

Interwoven wire mesh used in preferred embodiment arrays and fabrication processes of the invention is often used as a particle filter. In an embodiment of the invention consistent with FIG. 1C, alternating layers of interwoven wire mesh in a three-dimensional structure have microplasmas established in their microcavities. The remaining layers of mesh have either no voltage applied between the crossing sets of electrodes, or a voltage too small to result in plasma generation (i.e., breakdown) is applied. These stages can serve to charge (if necessary) and trap particles produced in the other layers. Such a system is well suited for plasma reactors operating in gases which normally generate particles (soot). Arrays of the invention can be flexible, and are therefore not limited to applications requiring flat arrays. FIG. 2 illustrates a method for making a cylindrical array of the invention. As shown in FIG. 2, the fabrication process for a single layer cylindrical array begins with a rectangular section of interwoven aluminum wire mesh 20 (individual wires in the mesh are not illustrated). Four corners 22 are cut out, and the mesh 16 is rolled into a cylinder.

An experimental cylindrical array of microcavity plasma devices of the invention has been fabricated in aluminum wire fabric. All the wires in one set (i.e., x coordinate) were connected by silver epoxy. The same was then done for all the wires in the other set (y coordinate). A wire electrode was then connected to each of the two sets and the electrode connection was coated with photoresist so as to protect it during the anodization process. The diameter of each aluminum wire in the exemplary mesh used to form the experimental array was 101.6 μm (i.e., four one-thousandths of an inch) and the mesh has 120 of these wires per inch along both the x and y coordinates. This means that the openings in the mesh (spaces between the wires) are 102×102 $\mu m^2$ squares. The type of weave for this particular mesh is known as "two over, two under", and the x and y axis wires were substantially straight and crossed at right angles to each other. The entire cylinder was then anodized for 20 hours in a 0.15 M solution of oxalic acid. The finished device was then placed into a vacuum chamber backfilled with Ne and the device was driven with a 20 kHz sinusoidal voltage. The entire cylinder glowed with red-emitting plasma and the uniformity of the emission was excellent.

Figure 3:
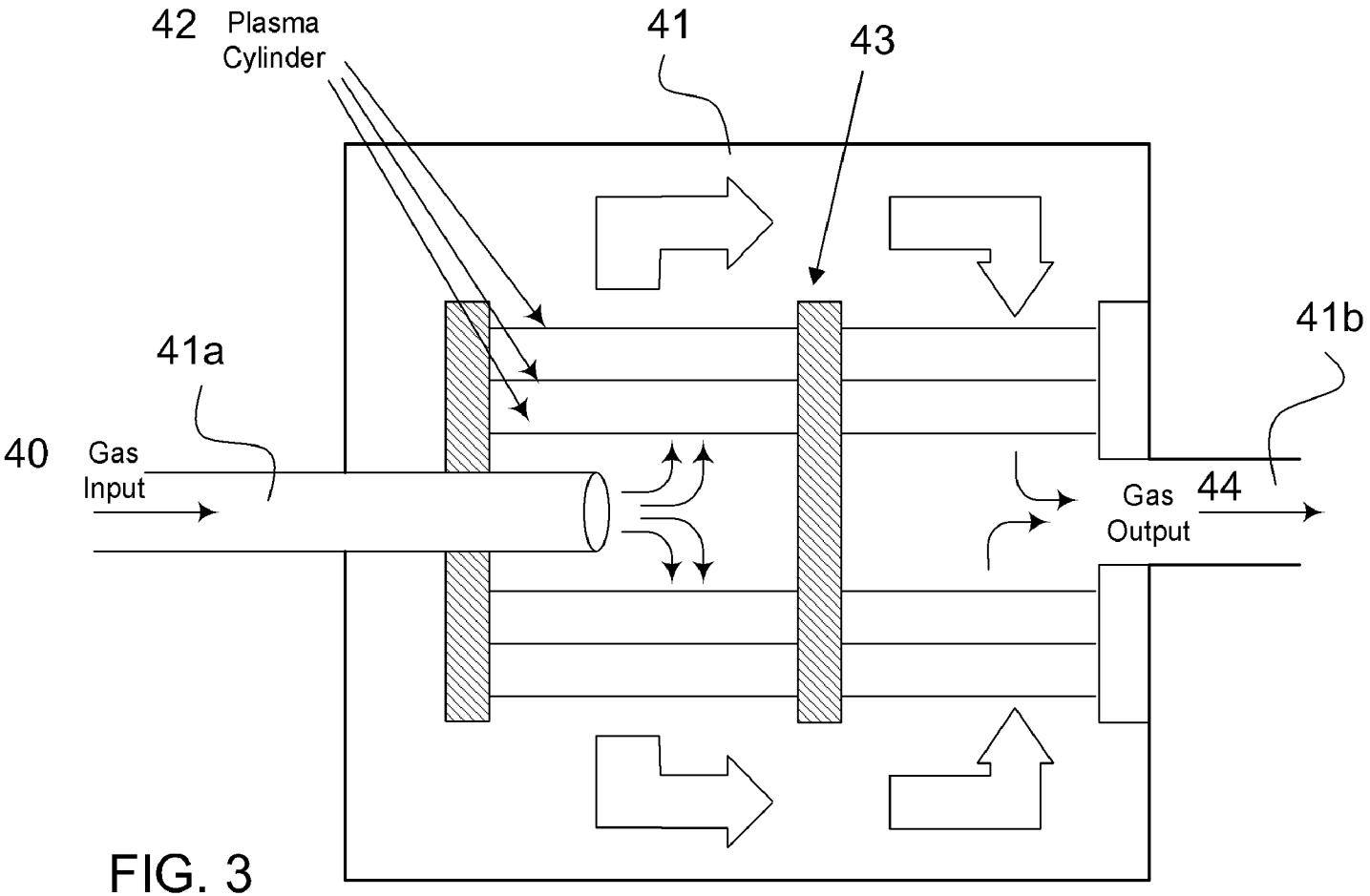
FIG. 3 is a schematic diagram illustrating a plasma processing system of the invention formed from cylindrical arrays of microcavity plasma devices of the invention.

FIG. 3 illustrates a plasma processing system that uses several cylindrical arrays of wire mesh microcavity plasma devices. A gas flow stream 40 containing a toxic or environmentally hazardous contaminant (for example) is introduced through an entrance port 41*a* into a tube 41 that lies along the axis of several concentric plasma cylinders 42 having different diameters. Each cylinder, in effect, serves as one stage of a multistage plasma processing system. The cylinders 42 are mounted on mounts 43, which can also provide electrical connections to the electrodes of the cylinders 42. The system is designed such that the input gas must travel through the set of three plasma cylinders at least twice. Gas 44 emerging from the last cylinder exits the enclosure through a port 41*b* and is collected and processed further, if necessary. The plasma produced by each cylinder serves to break up (dissociate) the toxic or undesired species.

Figure 4:
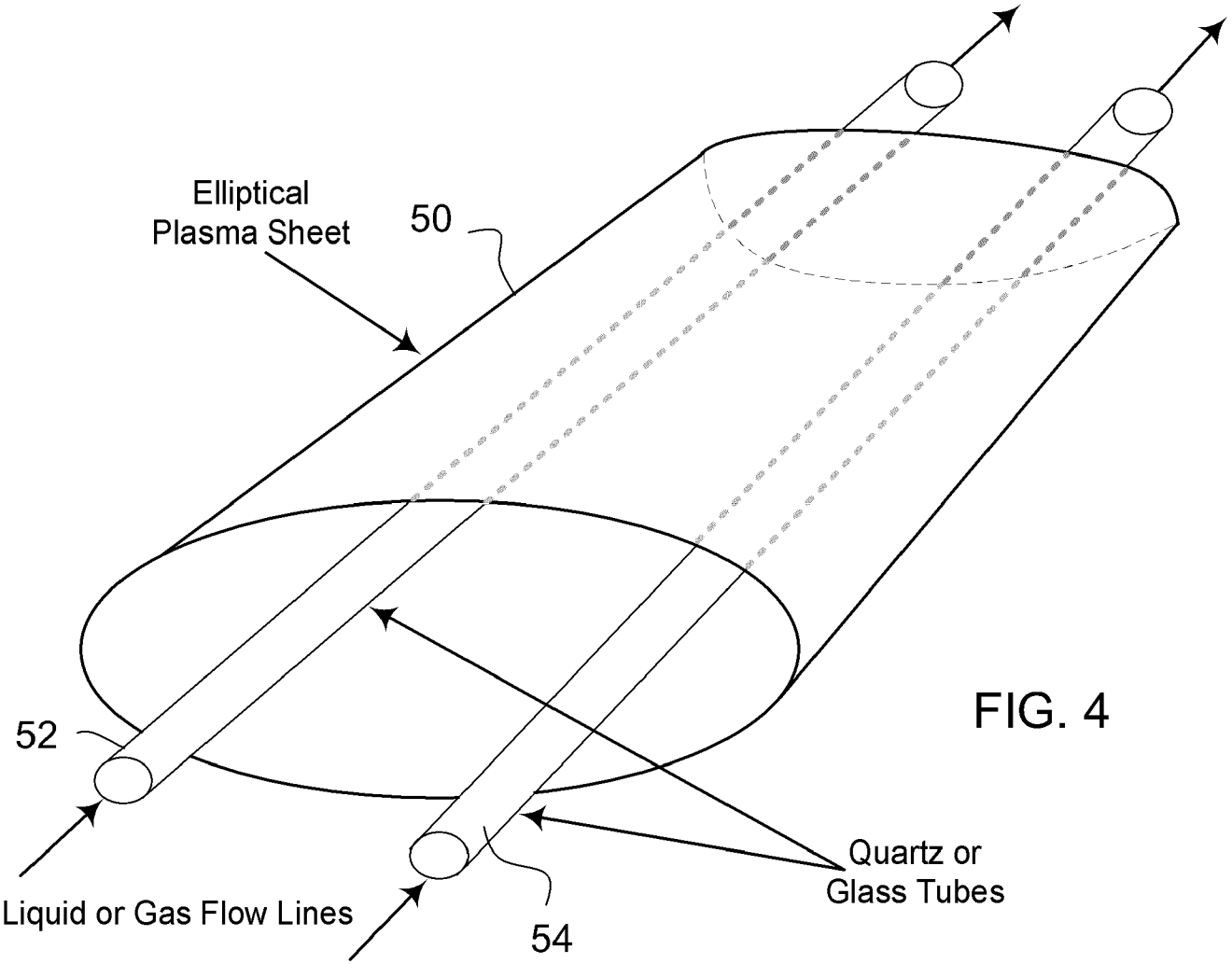
FIG. 4 is a diagram illustrating a gas or liquid treatment system based upon an array of microcavity plasma devices of the invention formed into an ellipse.
Figure 5:
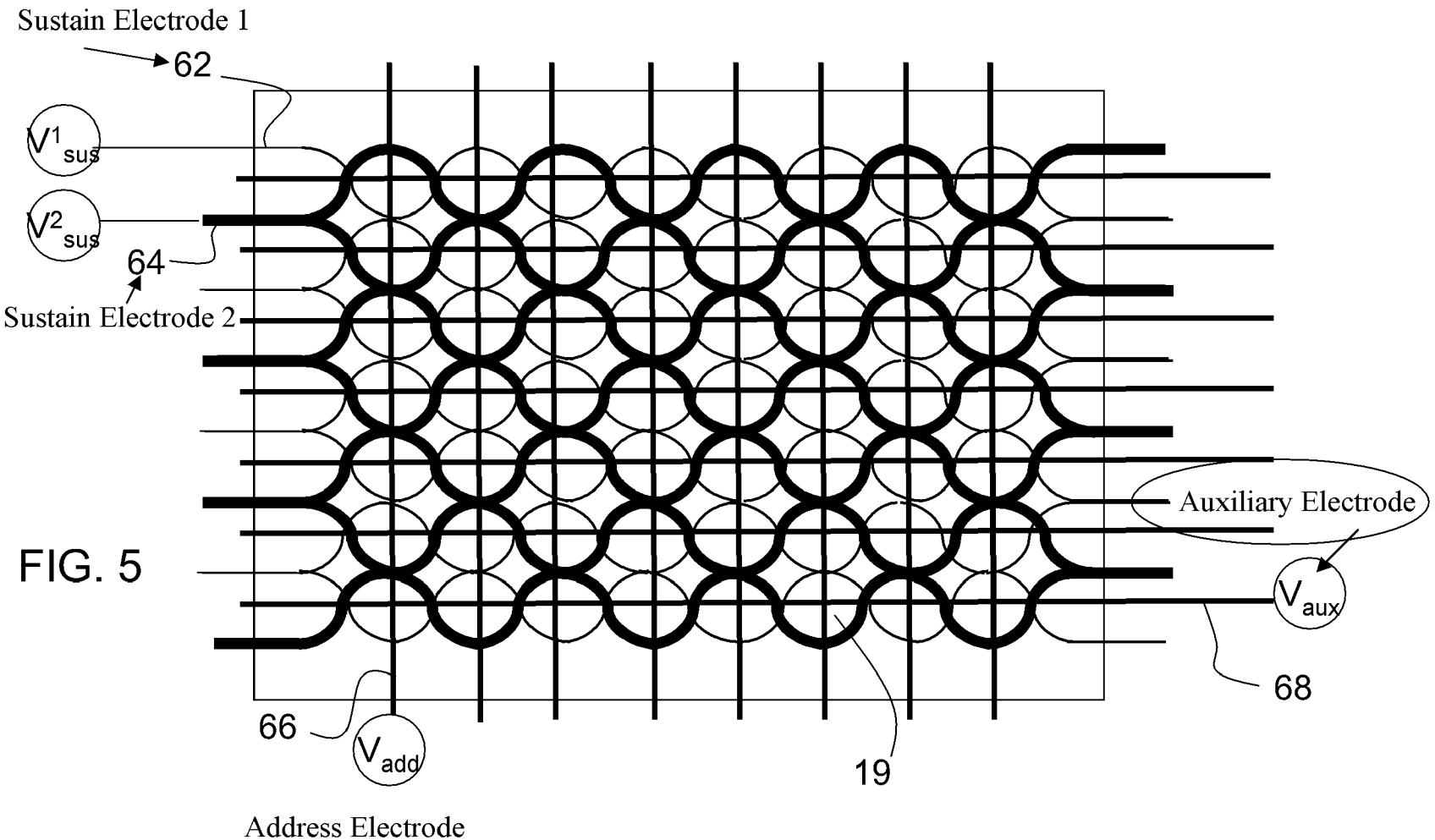
FIG. 5 is a top view of a preferred embodiment addressable array of microcavity plasma devices of the invention.

FIG. 4 illustrates a gas or liquid treatment system based upon an elliptical array 50 of wire mesh microcavity plasma devices of the invention. Gas or liquid flow lines 52, 54 are disposed at the foci of the elliptical cross-section array of microcavity plasma devices 50. Because every ellipse has two foci, light produced by the plasma array will be focused to two lines coincident with the two foci of the elliptical plasma sheet where the gas or liquid flow lines 52, 54 are disposed. Additionally, a reflector (not shown) could be placed around the plasma ellipse so as to direct more radiation back toward the flow lines. Such a system is well-suited for treating gases or liquids with ultraviolet (UV) radiation. Because of the flexibility of the wire mesh microplasma arrays, one also has the option of wrapping the arrays around the liquid or gas flow lines themselves.

Another variation is a plasma cone of wire mesh microcavity plasma devices of the invention. An application for such microplasma cones (aside from decorative applications) is in aerospace. Studies have shown that plasma produced near the leading surfaces of an aircraft reduces drag, thereby increasing velocity. Arrays of the invention can provide large area plasma sources capable of covering the front of an aircraft.

Interwoven wire mesh lends itself very well to the realization of displays that are particularly attractive as signage. While the x and y axis wire mesh electrodes illustrated so far have generally straight wires arranged to cross at right angles, other arrangements that produce different shaped microcavities are also possible. FIG. 6 illustrates a weave array of addressable microcavity plasma devices of the invention. In the FIG. 6 embodiment, the x and y wires are not straight, and instead have a "mat" weave that forms microcavities 19 that have an elliptical shape. FIG. 6 shows rows of mat style interwoven sustain electrodes 62, 64, both of which are encapsulated in an oxide. Also illustrated is an optional second array of, respectively, address and auxiliary electrodes 66, 68, which are used to address rows of pixels with the voltage applied as shown in FIG. 6. The auxiliary electrodes 68 provide additional power that is helpful to drive and modulate the plasma when the maximum separation between the sustain electrodes 62, 64 is large (more than several hundred μm). For smaller microcavities (sustain electrode separations), the auxiliary electrodes 68 may be omitted. The address electrodes can also be omitted if addressing is not required. In the case of large separations (>several hundred μm), the auxiliary electrode is desirable to reliably ignite a pixel. Also, the address and/or auxiliary electrodes need not be disposed at right angles to the sustain electrodes, but may cross the pixels at other angles, e.g., 45 degrees.

Arrays of the invention have many applications. Addressable devices can be used as the basis for both large and small high definition displays, with one or more microcavity plasma devices forming individual pixels or sub-pixels in the display. Microcavity plasma devices in preferred embodiment arrays, as discussed above, can generate ultraviolet radiation to photoexcite a phosphor to achieve full color displays over large areas. An application for a non-addressable or addressable array is, for example, as the light source (backlight unit) for a liquid crystal display panel. Embodiments of the invention provide a lightweight, thin and distributed source of light that is preferable to the current practice of using a fluorescent lamp as the backlight. Distributing the light from a localized lamp in a uniform manner over the entire liquid crystal display requires sophisticated optics. Non-addressable arrays provide a lightweight source of light that can also serve as a flat lamp for general lighting purposes. Arrays of the invention also have application, for example, in sensing and detection equipment, such as chromatography devices, and for phototherapeutic treatments (including photodynamic therapy). The latter include the treatment of psoriasis (which requires ultraviolet light at ~308 nm), actinic keratosis and Bowen's disease or basal cell carcinoma. Inexpensive arrays sealed in glass or plastic now provide the opportunity for patients to be treated in a nonclinical setting (i.e., at home) and for disposal of the array following the completion of treatment. These arrays are also well-suited for photocuring of polymers which requires ultraviolet radiation, or as large area, thin light panels for applications in which low-level lighting is desired. Interwoven wire mesh lends itself well to the realization of inexpensive displays that are particularly attractive as signage.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An array of microcavity plasma devices, comprising:

first and second sets of electrodes in an interwoven wire mesh, wires in said interwoven wire mesh being encapsulated in oxide to electrically isolate wires from each other;

microcavities formed by spaces between oxidized wires of the first and second sets of electrodes.

2. The array of claim 1, further comprising packaging to contain discharge medium in the microcavities.

3. The array of claim 2, wherein all of the wires in said interwoven wire mesh are substantially isolated from all other wires in the interwoven wire mesh by the oxide.

4. The array of claim 1, wherein said interwoven wire mesh comprises a straight weave that forms generally rectangular microcavities.

5. The array of claim 4, further comprising a set of address electrodes arranged to provide addressing of said microcavities.

6. The array of claim 1, wherein said interwoven wire mesh comprises a mat style weave that forms substantially elliptical microcavities.

7. The array of claim 6, further comprising a set of auxiliary electrodes arranged to provide additional power to sustain and/or modulate plasma in said microcavities.

8. The array of claim 1, further comprising a set of address electrodes arranged to provide addressing of said microcavities.

9. The array of claim 1, further comprising:

packaging to contain discharge medium in the microcavities; and phosphors disposed on said packaging and arranged to be excited by plasma formed in said microcavities.

10. The array of claim 9, further comprising additional sets of first and second electrodes that form an additional interwoven mesh arranged to form a three-dimensional array.

11. The array of claim 9, wherein the array is substantially transparent.

12. The array of claim 1, further comprising packaging to contain discharge medium in the microcavities, wherein the packaging comprises one or more layers of glass, plastic or quartz.

13. The array of claim 1, further comprising packaging to contain discharge medium in the microcavities, wherein the array consists of a single layer of the first and second electrodes formed from the interwoven wire mesh and the oxide.

14. The array of claim 1, packaged in plastic.

15. A method of fabricating an array of microcavity plasma devices, comprising steps of:

obtaining an interwoven wire mesh; and anodizing wires in the interwoven wire mesh to form an oxide encapsulated wire mesh by encapsulating wires in the interwoven wire mesh in oxide to isolate wires from each other in the interwoven wire mesh.

16. The method of claim 15, further comprising a step of packaging the interwoven wire mesh with discharge medium in microcavities defined by the spacing of wires in the interwoven wire mesh.

17. The method of claim 16, wherein said step of packaging comprises packaging the oxide encapsulated wire mesh in one of glass, plastic or quartz packaging.

18. The method of claim 16, wherein said step of packaging comprises:

heating the oxide encapsulated wire mesh;

bringing the oxide encapsulated wire mesh into contact with a plastic film;

permitting the oxide encapsulated wire mesh and the plastic film to cool, thereby fixing the oxide encapsulated wire mesh and the plastic film.

19. The method of claim 18, wherein said step of packaging further comprises fixing a second plastic film to another side of the oxide encapsulated wire mesh.

20. The method of claim 18, further comprising a step of sealing ends of the wire mesh by slightly heating plastic at edges of the array and embedding the wire mesh ends in the plastic.

21. The method of claim 15, where said step of anodizing substantially insulates all wires in the interwoven wire mesh from all other wires in the interwoven wire mesh.

22. An array of microcavity plasma devices, comprising:

an oxide encapsulated, wire metal mesh defining at least two separate electrodes and a plurality of microcavities; and discharge medium contained in said microcavities.

23. The array of claim 22, wherein all wires in the metal mesh are insulated from all other wires in the metal mesh by oxide encapsulation.

24. The array of claim 22, packaged in one of glass, plastic or quartz.

25. The array of claim 22, being substantially transparent.

26. The array of claim 22, being flexible.

27. The array of claim 22, formed into one of a cylinder or an ellipse.

28. The array of claim 22, wherein said wire metal mesh comprises a straight weave.

29. The array of claim 22, wherein said wire metal mesh comprises a mat style weave.

30. A plasma processing system, the system comprising:

an enclosure;

input and output ports to provide gas flow in and out of said enclosure; and a plurality of arrays according to claim 1 formed into cylinders and being arranged to accept said gas flow through multiple plasma stages and dissociate or excite species in the gas flow via plasma processing.

31. A gas or liquid processing system, the system comprising:

an array according to claim 1 formed into an ellipse; and gas or liquid flow lines within the ellipse and situated at the foci of the ellipse.

* * * * *

UNITED STATES PATENT AND TRADEMARK OFFICE

CERTIFICATE OF CORRECTION

PATENT NO. : 8,362,699 B2
APPLICATION NO. : 12/682973
DATED : January 29, 2013
INVENTOR(S) : Eden et al.

It is certified that error appears in the above-identified patent and that said Letters Patent is hereby corrected as shown below:

On the Title Page:

(57) Abstract:

Page 1, right column,
Abstract, line 7 Please delete "πight" and insert --right-- therefor.

Other Publications:

Page 2, right column, line 11 Before "Park," please delete "6.".

Signed and Sealed this
Thirtieth Day of July, 2013

Teresa Stanek Rea
*Acting Director of the United States Patent and Trademark Office*